US008277267B1

(12) United States Patent
Chippas

(10) Patent No.: US 8,277,267 B1
(45) **Date of Patent: *Oct. 2, 2012**

(54) AMPHIBIOUS PADDLE TRACK PROPULSION SYSTEM

(76) Inventor: Louis H. Chippas, West Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/017,632

(22) Filed: Jan. 31, 2011

Related U.S. Application Data

(63) Continuation of application No. 12/388,000, filed on Jun. 29, 2009.

(60) Provisional application No. 61/130,123, filed on May 28, 2008.

(51) Int. Cl.
*B63H 19/08* (2006.01)

(52) U.S. Cl. ..... 440/12.63

(58) Field of Classification Search ..... 440/12.63
See application file for complete search history.

(56) References Cited

U.S. PATENT DOCUMENTS

| | | | | |
|---|---|---|---|---|
| 121,738 | A | 12/1871 | Whitehead | |
| 413,852 | A | 10/1889 | French | |
| 464,621 | A | 12/1891 | Fisher | |
| 583,762 | A | 6/1897 | Moore | |
| 921,823 | A | 5/1909 | Gays | |
| 1,729,974 | A | 10/1929 | Watson | |
| 1,869,136 | A | 7/1932 | Farraguto | |
| 1,928,511 | A | 9/1933 | Martin | |
| 2,416,128 | A | 2/1947 | Swennes | |
| 2,878,883 | A | 3/1959 | France et al. | |
| 2,916,006 | A | 12/1959 | Crandall | |
| 2,980,054 | A | 4/1961 | Sanders | |
| 4,433,634 | A * | 2/1984 | Coast | 440/12.64 |
| 4,511,338 | A | 4/1985 | Fanelli | |
| 4,772,237 | A * | 9/1988 | Zalkauskas | 440/96 |
| 5,226,843 | A | 7/1993 | Yun | |
| 6,083,065 | A | 7/2000 | Hall | |
| 3,353,618 | A1 | 11/2010 | Fisher | |
| 7,980,907 | B1 * | 7/2011 | Chippas | 440/97 |
| 2009/0298360 | A1 | 12/2009 | Chippas | |
| 2009/0305585 | A1 | 12/2009 | Chippas Reilly | |

* cited by examiner

*Primary Examiner* — Stephen Avila
(74) *Attorney, Agent, or Firm* — Malin Haley DiMaggio Bowen & Lhota, P.A.

(57) ABSTRACT

An amphibious paddle track propulsion system mountable on any water or land vehicle for enabling the ability to selectively travel over land or water, the paddle track propulsion system having a paddle track, spring-loaded paddles, paddle supporting terrain treads, terrain treads, lead and rear sprockets, chain sprocket, engaging assembly for extending and retracting the paddles and lever for controlling the engaging assembly wherein each paddle has an engager extension that is engaged and disengaged by the engaging assembly to extend and retract paddles.

14 Claims, 13 Drawing Sheets

AMPHIBIOUS PADDLE TRACK PROPULSION SYSTEM

CROSS REFERENCE TO RELATED APPLICATIONS

This application is a continuation of application Ser. No. 12/388,000 filed Jun. 29, 2009 which claims the benefit of provisional patent application Ser. No. 61/130,123 filed May 28, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to an amphibious locomotion propulsion system, and more particularly, to an amphibious retractable paddling propulsion system for adaptation to any type vehicle to allow the vehicle to drive over land or water.

2. Description of the Background Art

There are several amphibious vehicles known for travel over land and, or water. Water bicycles that employ paddles are known as well. There are also a variety of water vessels that employ propulsion systems that are not meant for land use. The amphibious vehicles known require a water-tight body as they are partially submerged when driven in water. These amphibious vehicles fail to employ a retractable paddle and track system. In addition, these vehicles and devices are not adapted for use on any type of vehicle to make it amphibious. If a retractable paddle track system were available for converting any vehicle into an amphibious vehicle without requiring a water tight body it would be well received for recreational, military, police and rescue use. However, there are no such systems known.

As noted, there are a variety of land, water and amphibious vehicles disclosed in the prior art. With respect to amphibian vehicles, U.S. Pat. No. 2,416,128, issued to Swennes, discloses an amphibian vehicle having a watertight body and a track and series of treads for locomotion. Swennes has tracks on both sides of the vehicle with lugs and grousers and sprockets that are used to propel the vehicle through water. U.S. Pat. No. 2,878,883, issued to France et al., discloses an amphibian vehicle having a buoyant watertight hull with a vehicle cab superimposed thereon. The France et al. includes a propeller and steering rudder for propulsion through water and front and rear traction assemblies for moving the vehicle over rough terrain. U.S. Pat. No. 2,916,006, issued to Crandal, discloses an amphibian vehicle having a watertight body, rudder and series of roller bags or wheels that are inflatable to provide desired flotation of the vehicle on unstable soils such as sand, swamps, mud and the like. Each roller bag of the bottom lay has an effective pressure area to water for exerting a pressure force against the water advance the vehicle. The watertight body together with the inflatable roller bags provide for flotation of the vehicle. U.S. Pat. No. 3,353,618, issued to Fisher, discloses an all terrain articulated vehicle having two similar four-wheeled or two-tracked vehicle bodies wherein the vehicle bodies are articulately connected by a universal joint. Fisher includes tracks around pairs of wheels with a series of treads for locomotion.

Several paddle driven vehicles are also known in the background art. For instance, U.S. Pat. No. 4,511,338, issued to Fanelli, discloses a water bicycle and detachable device for converting a sail board into a water bicycle. The water bicycle has a flotation member and a frame removably mounted to the flotation member and pedals rotatably mounted to the frame. Paddle wheels are provided on on either side of the frame and are interconnected with the pedals so as to be rotatably driven by the pedals. U.S. Pat. No. 5,226,843, issued to Yun, discloses an amphibian bicycle including a bicycle body, two pairs of air tubes, air tube supporting members, a pair of wheels wherein the rear wheel is fitted with a plurality of paddles or wheel webs, front brake locking member, a rear brake pad lifting member and a ratchet gearing stopper. For land operation, the air tubes, air tube supporting members, the direction controller, and the wheel webs are separated from the amphibian bicycle. U.S. Pat. No. 6,083,065, issued to Hall, discloses a paddle wheel propulsion device kit which can be removably affixed to a canoe and like watercraft. A folding and removable paddle wheel fender prevents water from entering the watercraft while moving under power. The propulsion power includes a chain drive from a bicycle type mechanism with soft pedals and removably anchored inside the watercraft.

A variety of propulsion systems for water vessels are also known in the background art. For instance, U.S. Pat. No. 121,738, issued to Whitehead, discloses a propulsion system for canal-boats having a series of blades or paddles attached to and operated by an endless band or chain, the blades being operated within a channel in the bottom of the boat and constructed so they remain in a vertical position when moving from stem to stern of the boat. U.S. Pat. No. 464,621, issued to Fisher, discloses a propulsion system for water vessels having a plurality of vanes or propellers attached to an endless chain consisting of a series of links adapted to be engaged by sprocket wheels. U.S. Pat. No. 921,823, issued to Gays, discloses a boat propulsion system having two members arranged at wither side of the hull of the vessel, wherein in each member there has a plurality of paddles or buckets, driving means for driving the paddles, a bucket carrier for each of the members and a bucket trip means. The paddles or buckets are caused to traverse, in each member, paths of travel in a horizontal plane. Finally, U.S. Pat. No. 1,729,974, issued to Watson, discloses a propeller for driving water vessels in opposite directions without reversing the direction of the propeller travel. Watson's propeller includes an endless propeller chain adapted to travel over a pair of spaced sprocket wheels mounted on drive shafts, a chain having sprocket links and connecting links having outstanding portions rotatably secured to paddles or vanes. A single chain and paddle structure as described is secured on each side of the water vessel.

The background art also includes a number of other vehicles that fail to address amphibious travel and corresponding shortcomings. U.S. Pat. No. 413,852, issued to French, discloses a chain propeller system that is not adapted for amphibious travel as contemplated by the instant invention. U.S. Pat. No. 583,762, issued to Moore, discloses a propeller for boats that is not adapted for land travel. U.S. Pat. No. 1,869,136, issued to Farraguto, discloses a means for the propulsion of ships or similar vessels. U.S. Pat. No. 1,928,511, issued to Martin, discloses a buoyant propulsion device for a vehicle or boat that may be used on land or water. Martin, however, fails to disclose a retractable paddle system. U.S. Pat. No. 2,980,054, issued to Sanders, discloses an amphibious vehicle that purports to lend itself to ease of steering. U.S. Pat. No. 4,772,237, issued to Zalkauskas, discloses a paddle boat that is not amphibious.

As can be seen, the foregoing patents fail to disclose a retractable track paddling propulsion system for adaptation to any type vehicle to allow the vehicle to drive over land or water. The foregoing patents also fail to teach a track paddling propulsion system having collapsible or retractable paddles for allowing travel over land wherein the paddles are extendable for water locomotion. In addition, the background patents fail to teach a water propulsion system wherein only the paddles are exposed to and engage the water to avoid unnecessary drag. If there was such a propulsion system it would address the shortcomings in the background art and be well received for use in recreation, the military and by rescue personnel. As there are no known amphibious propulsion system having these specifications and attributes, there exists a need for such a device. It is, therefore, to the effective resolution of the aforementioned problems and shortcomings of the prior art that the present invention is directed. The instant invention addresses this unfulfilled need in the prior art by providing an amphibious paddle track propulsion system as contemplated by the instant invention disclosed herein.

BRIEF SUMMARY OF THE INVENTION

In light of the foregoing, it is an object of the present invention to provide an amphibious paddle track propulsion system to allow a vehicle to travel on land or water.

It is a primary object of the instant invention to provide an amphibious paddle track propulsion system that can be mounted on a floating vessel or a cycle to provide a means of amphibian locomotion with paddle track wherein the paddle maintains a parallel position to the track for terrain locomotion and can be triggered to a perpendicular position for water locomotion.

It is also an object of the instant invention to provide an amphibious paddle track propulsion system having retractable paddles for allowing a vehicle to travel on land.

It is another object of the instant invention to provide an amphibious paddle track propulsion system having extendable paddles for allowing a vehicle to travel on water.

It is an additional object of the instant invention to provide an amphibious paddle track propulsion system designed so that only the paddles engage the water to avoid unnecessary drag.

It is a further object of the instant invention to provide an amphibious paddle track propulsion system that is adaptable for use and mounting on any type of vehicle or vessel.

It is yet a further object of the instant invention to provide an amphibious paddle track propulsion system that is adaptable for use and mounting on any floater.

It is yet another object of the instant invention to provide an amphibious paddle track propulsion system that may be powered by peddling.

It is yet an additional object of the instant invention to provide an amphibious paddle track propulsion system that may be powered by a motor.

In light of these and other objects, the instant invention comprises an amphibious paddle track propulsion system that may be mounted on any floater, water vessel or other vehicle for enabling the ability to selectively travel over land or water. The paddle track propulsion system comprises a paddle track mounted for rotation about its horizontal axes and a plurality of spring-loaded paddles for propelling a vessel or a cycle in water when extended or on land when retracted. The paddle track propulsion system has an elongated frame wherein the leading and trailing ends each have a drum gear sprocket for rotation. A flexible paddle track is mounted on the drum gear sprockets for rotation by way of a pedal or motor. The track includes a plurality of circular terrain treads. The circular terrain treads are secured to the paddle track in traverse orientation with respect to the track and along the periphery of the track so as to engage corresponding notches in the gear sprockets. The paddle track is flexible or hinged and has the plurality of the hinged paddles mounted on the track capable of hinging ninety degrees (90) to engage water or terrain locomotion or retracted to zero degrees when not needed. The paddles comprise a pair of parallel paddle engagers substantially perpendicular to the paddles for facilitating the extension and retraction of the paddles. The paddles are pivotally mounted to certain circular terrain treads. The paddle engagers fit through corresponding cutouts in the circular terrain treads and are secured to the track and terrain tread by a paddle hinge shaft that passes through a tread hinge aperture and a corresponding paddle aperture when properly aligned. The paddle engagers rest on the inner surface of the track and halts the paddle in a substantially perpendicular position with respect to the track for water locomotion when the paddles are engaged.

The frame also supports a trigger mechanism for engaging and disengaging the paddles for water or terrain locomotion. A selecting lever engages and disengages the paddles to extend them for water travel and retract them for land travel. The lever is connected to a pair of engaging beams to lower and raise the beam. When the engaging beams are lowered, they come in contact with the pair of paddle engagers causing the paddle to extend and remain extended until coming out of contact with the beam. The paddle engagers ride along the beams when traversing below the frame until riding up a gear sprocket as it returns to a position above the frame. When the engaging beams are raised, i.e. disengaged, the spring-loaded paddles automatically return to a retracted position. Each paddle comprises a torque spring having the necessary amount of torque to maintain the paddle parallel to the paddle track for terrain locomotion and to yield to water pressure for water locomotion.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described and certain features may be used independently or other features and the number and configuration of various paddle track components described above may be altered without departing from the spirit or scope of the invention as defined in the appended claims.

In accordance with these and other objects, which will become apparent hereinafter, the instant invention will now be described with particular reference to the accompanying drawings.

DETAILED DESCRIPTION OF THE INVENTION

Figure 1:
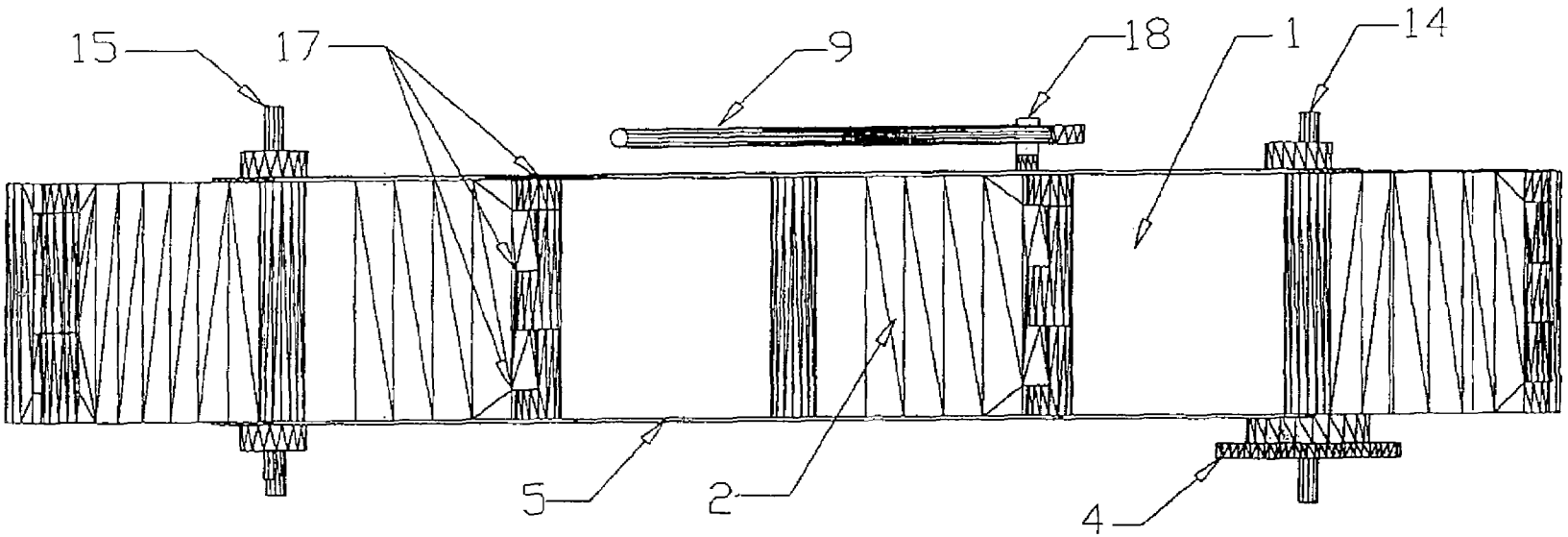
FIG. 1 is a plan view of the preferred embodiment of the paddle track propulsion system in accordance with the instant invention.

With reference to the drawings, FIGS. 1 to 13 depict the preferred embodiment of the instant invention which is generally referenced as a paddle track propulsion system. The paddle track propulsion system is mountable to any floater, vessel or vehicle for terrain and water locomotion and allows the user to select paddle engagement or disengagement. When traveling on the water, the paddle track propulsion system extends the paddles. The paddles are retracted for traversing land. The paddle track propulsion system may be powered by pedaling or with the use of a motor. The paddle track propulsion system provides a machine for amphibian propulsion unlike prior attempts in the background art.

With reference to FIGS. 1-13, the amphibious self-engaging paddle track propulsion system generally comprises an elongated flexible paddle track 1 rotatably supported by a pair of drum gear sprockets 3, a plurality of spring-loaded paddles 2, a chain sprocket 4 on the leading gear sprocket 3, a support frame or chassis 5, plurality of paddle support terrain treads 11', a plurality of circular terrain treads 11, a pair of engaging beams 6 and selector lever 9 for engaging and disengaging the beam 6. The paddle track 1 comprises a flexible or hinged material and together. The paddle track 1 is elongated horizontally of a given length and width and made of flexible or hinged material capable of rotating around the drum gear sprocket 3. The frame 5 bridges and secures the gear sprockets 3 and includes an adjusting slot 10 on its leading edge for creating the proper tension in the paddle track 1. The frame 5 is elongated along its horizontal axis and has a predetermined length and width and comprises support structure for the various components of the paddle track propulsion system.

Figure 7:
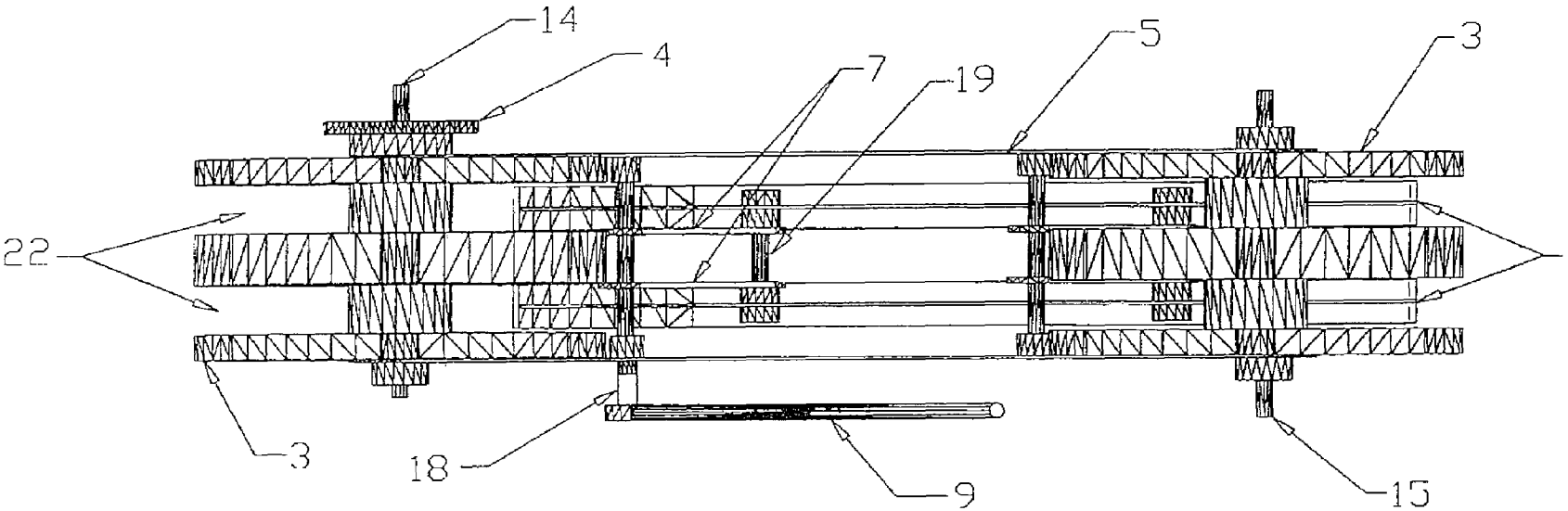
FIG. 7 is a plan view of the preferred embodiment of the paddle track propulsion system shown without the track in accordance with the instant invention.
Figure 8:
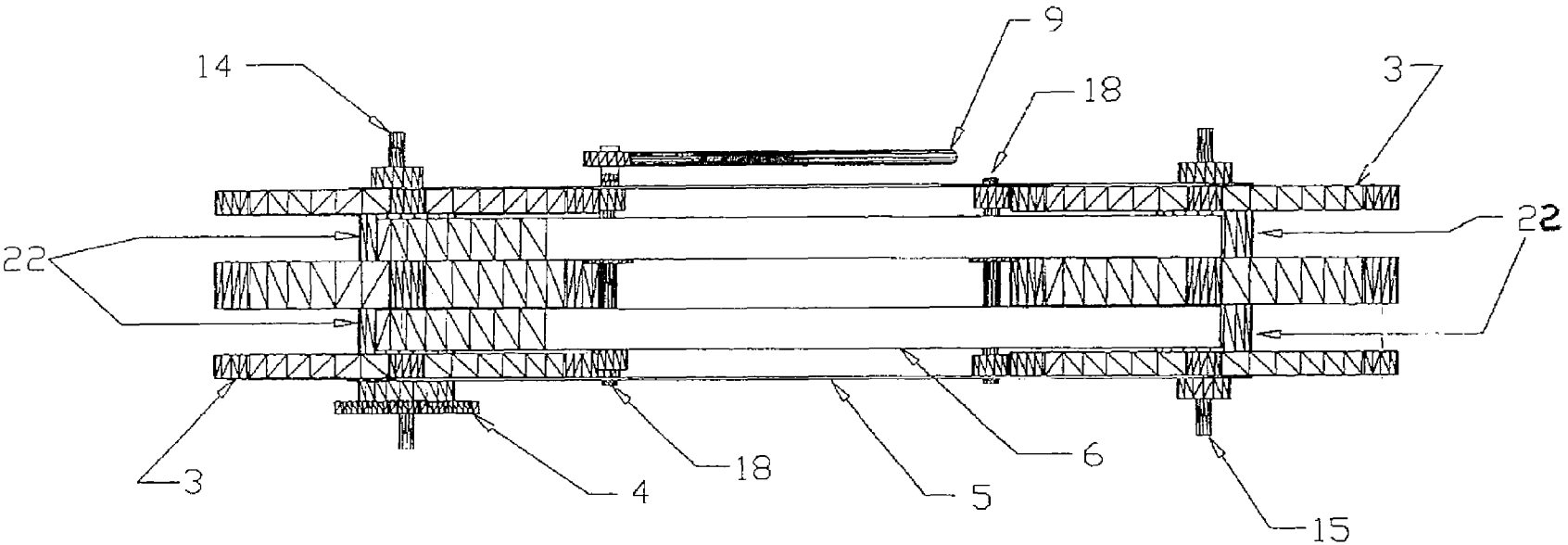
FIG. 8 is a bottom elevational view of the preferred embodiment of the paddle track propulsion system shown without the track in accordance with the instant invention.
Figure 9:
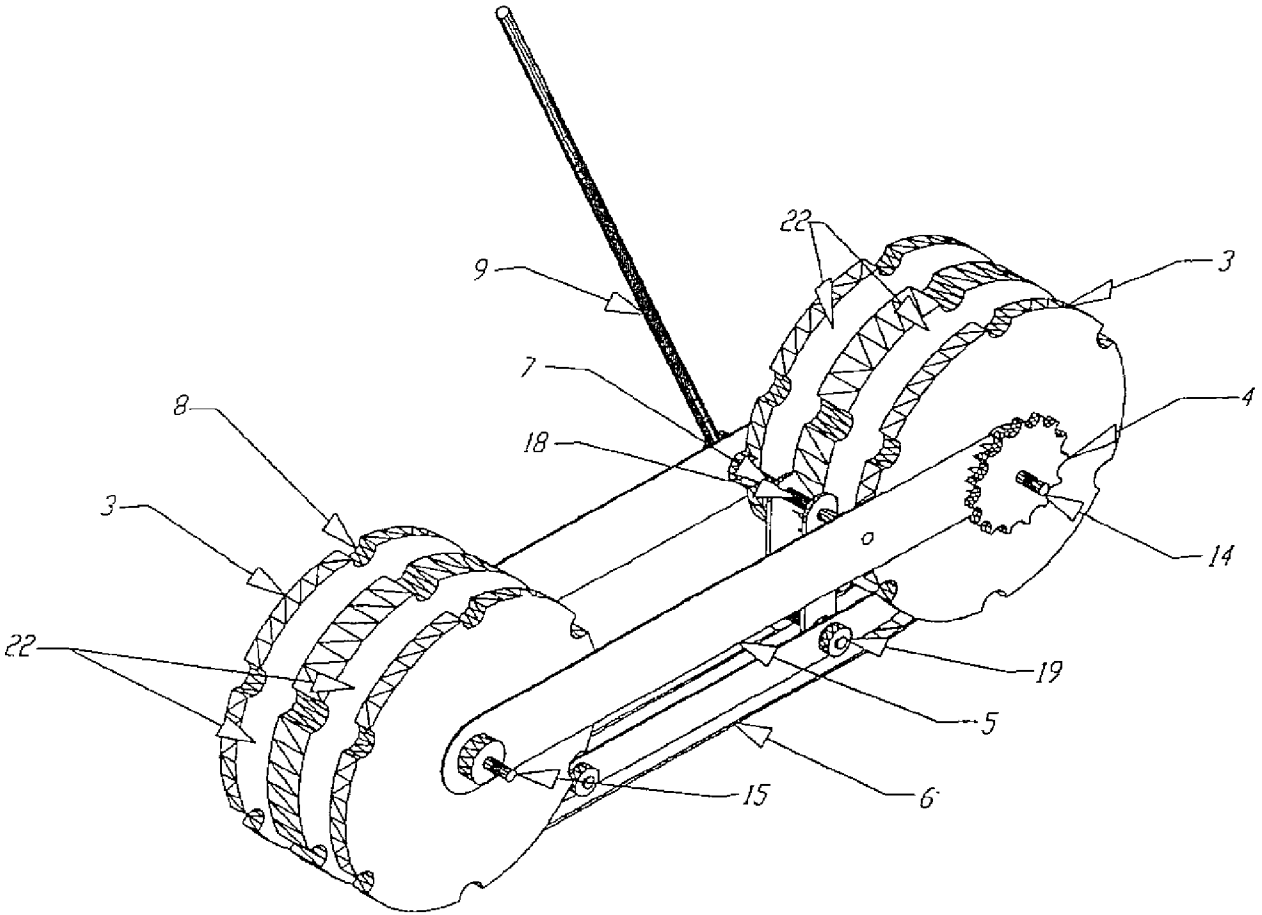
FIG. 9 is an isometric view of the frame, drum gear sprockets, selector lever, engaging beam and chain sprocket of the paddle track propulsion system in accordance with the preferred embodiment of the instant invention.
Figure 10:
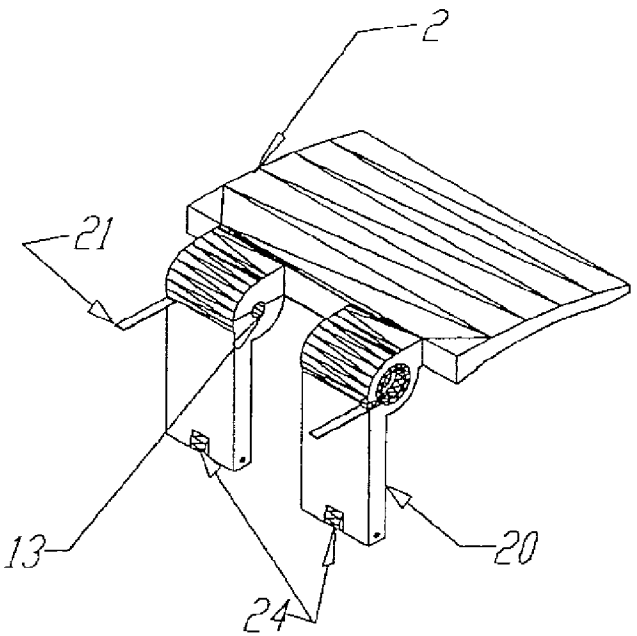
FIG. 10 shows isometric views of the paddle track with circular terrain treads and the paddle with paddle engagers of the paddle track propulsion system in accordance with the preferred embodiment of the instant invention.
Figure 10:
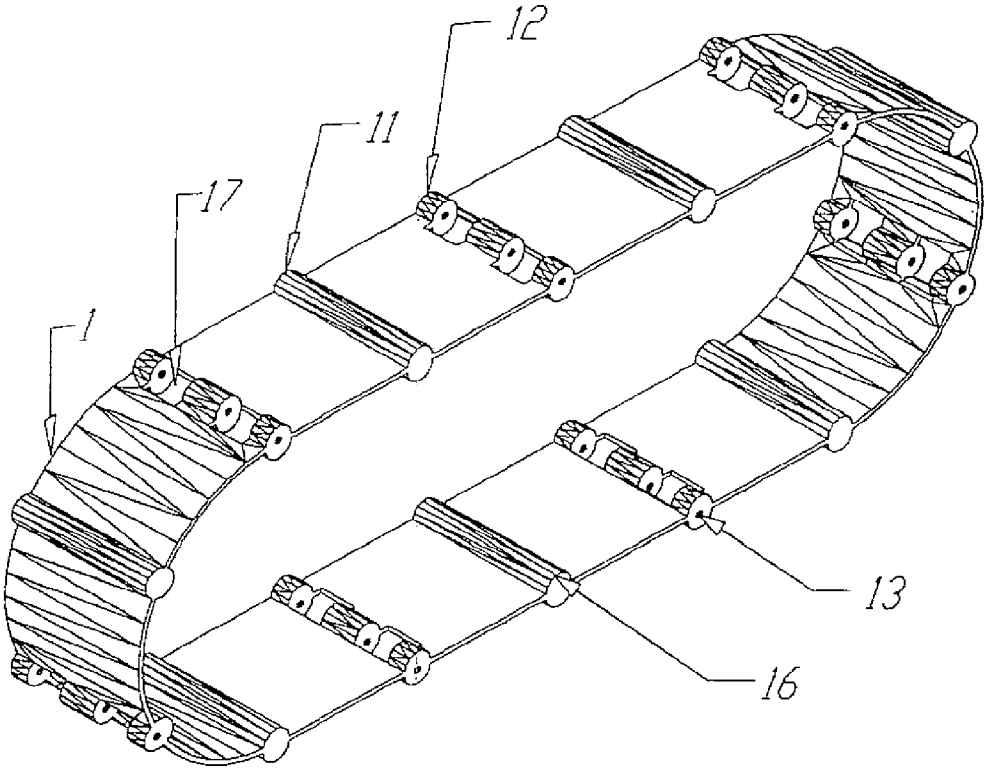
Figure 11:
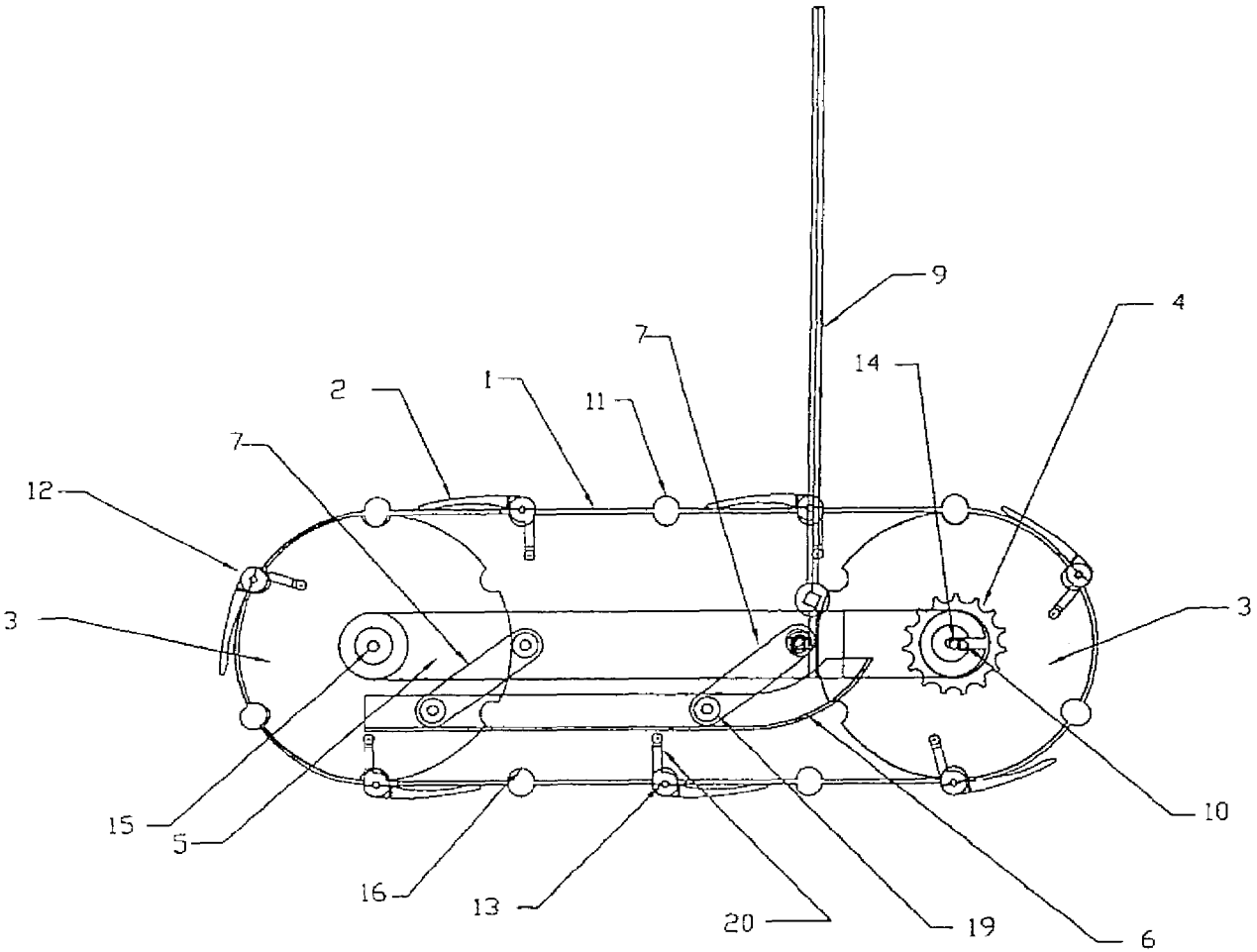
FIG. 11 is a side elevational view of the frame, drum gear sprockets, selector lever, engaging beam and chain sprocket of the paddle track propulsion system in accordance with the preferred embodiment of the instant invention.
Figure 12:
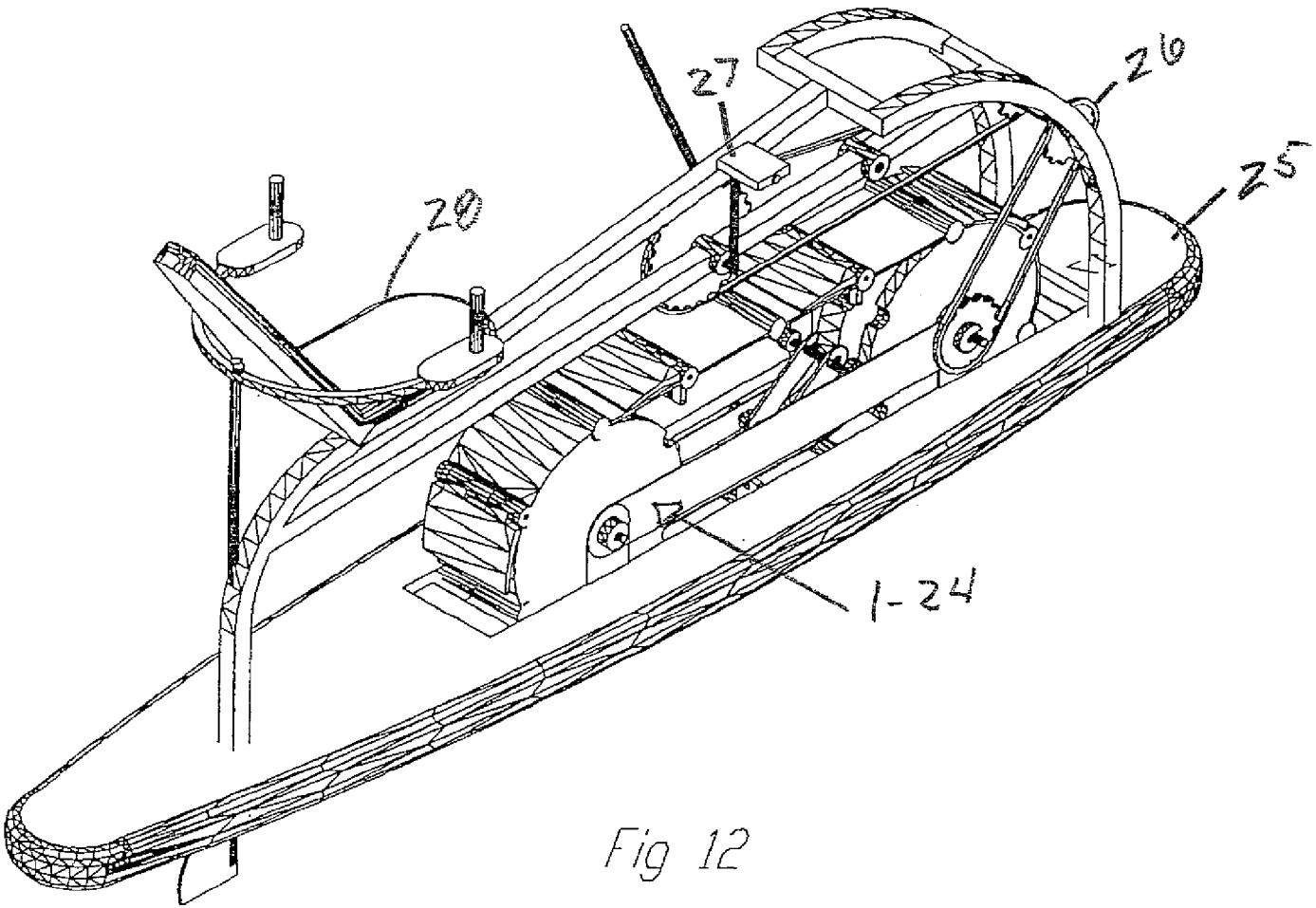
FIG. 12 is a perspective view of the preferred embodiment of the paddle track propulsion system mounted to a floater and fitted with a seat in accordance with the instant invention.

Still referring to FIGS. 1-13, the chain sprocket 4 is mounted on the front axle 14 to rotate the leading drum gear sprocket 3 by way of a chain connected to a motor or pedal system, as shown in FIG. 12. The chain sprocket 4 has the same pitch as the link chain and being driven by a power source. The paddle track 1 supports a series of circular terrain treads 11 traversing the outer perimeter of the paddle track 1 spaced apart a predetermined distance and a given number of paddle support terrain treads 11'. The drum gear sprockets 3 support the track 1 and include a plurality of circular pitch cutouts 8 spaced apart so as to receive the terrain treads 11, 11' as the gear sprockets 3 rotate and move the track. The drum gear sprockets 3 are hermetically sealed for buoyancy. The leading sprocket 3 is rotatably secured to the frame 5 with the front axle 14 and the rear sprocket 3 is rotatably secured to the frame by the rear axle 15. The paddle track 1 alternates between the paddle support treads 11' and terrain treads 11. The treads include circular teeth 16 that correspond to and mesh with the sprocket gears 3. Each paddle 2 includes a pair of paddle engagers 20 spaced apart in parallel and substantially perpendicular to the paddle 2, as shown in FIG. 10. The paddle support terrain treads 11' have cut out configurations 17 that define the paddle hinges 12 to receive the paddle engagers 20 and secure the paddle 2, which is also shown in FIG. 10. Still referring to FIG. 10, the inside perimeter of the paddle track 1 has a series of circular gear teeth 16 having the same pitch diameter as the drum gear sprocket 3. The hinge hole 13 facilitates the securing of the paddle 2 to the track 1. With reference to FIGS. 7 and 8, the drum gear sprockets 3 include drum spacing corridors 22 that allow the paddle engagers 20 to pass and remain parallel to the track 1 as it rotates.

With reference to FIGS. 2, 3 and 7-11, each paddle 2 is pivotally supported on a paddle support terrain tread 11' wherein the paddle engagers 20 pass through the cutouts 17 defined by the paddle support terrain treads 11'. The paddles 1 are manufactured from a flexible, semi-rigid or rigid material. Each paddle 2 comprises an L-shape body wherein the long leg of the paddle 2 is the actual paddle 2 that engages water and the shorter legs are the engagers 20. The paddle 2 has an X axis which defines the paddle 2, Y axis which define the paddle engagers 20 and Z axis which defines a paddle hinge 12. The paddle hinge 12 defines a hinge hole 13 traversing the X-Y axis for the purpose of pivotally securing the paddle 2 so it may be extended and retracted. The engaging beams 6 cause the paddles 2 to extend or retract when lowered or raised, respectively, by the selector lever 9. When the engaging beams 6 are lowered, they come in contact with the pair of paddle engagers 20 as the track rotates 1 causing the paddle 2 to extend and remain extended until coming out of contact with the beams 6. The paddle engagers 20 include rollers 24 that ride along the beams 6 when traversing below the frame 5 until riding up the gear sprocket 3 as it returns to a position above the frame 5. When the engaging beams 6 are raised, i.e. disengaged, the spring-loaded paddles 20 automatically return to a retracted position by virtue of torque springs 21. Each paddle 2 comprises torque springs 21 connected to the engagers 20 having the necessary amount of torque to maintain the paddle 2 parallel to the paddle track for terrain locomotion and to yield to water pressure for water locomotion. The track hinge passages 23 facilitate the securing of the paddles 2 to the paddle track 1 with hinge shafts.

The chain sprocket 4 receives the power required for rotating the leading drum gear sprocket 3. The frame 5 is horizontally elongated with predetermined dimensions. The leading edge of the frame 5 has an adjusting slot 10 traversing and along the longitudinal center axis of the frame 5 for receiving and positioning the lead sprocket 3. The trailing edge of the frame 5 has an aperture traversing and along the longitudinal center axis of the frame 5 for receiving the rear axle 15 of the rear sprocket 3. The frame adjusting slot 10 allows for adjusting track 1 tension.

Figure 2:
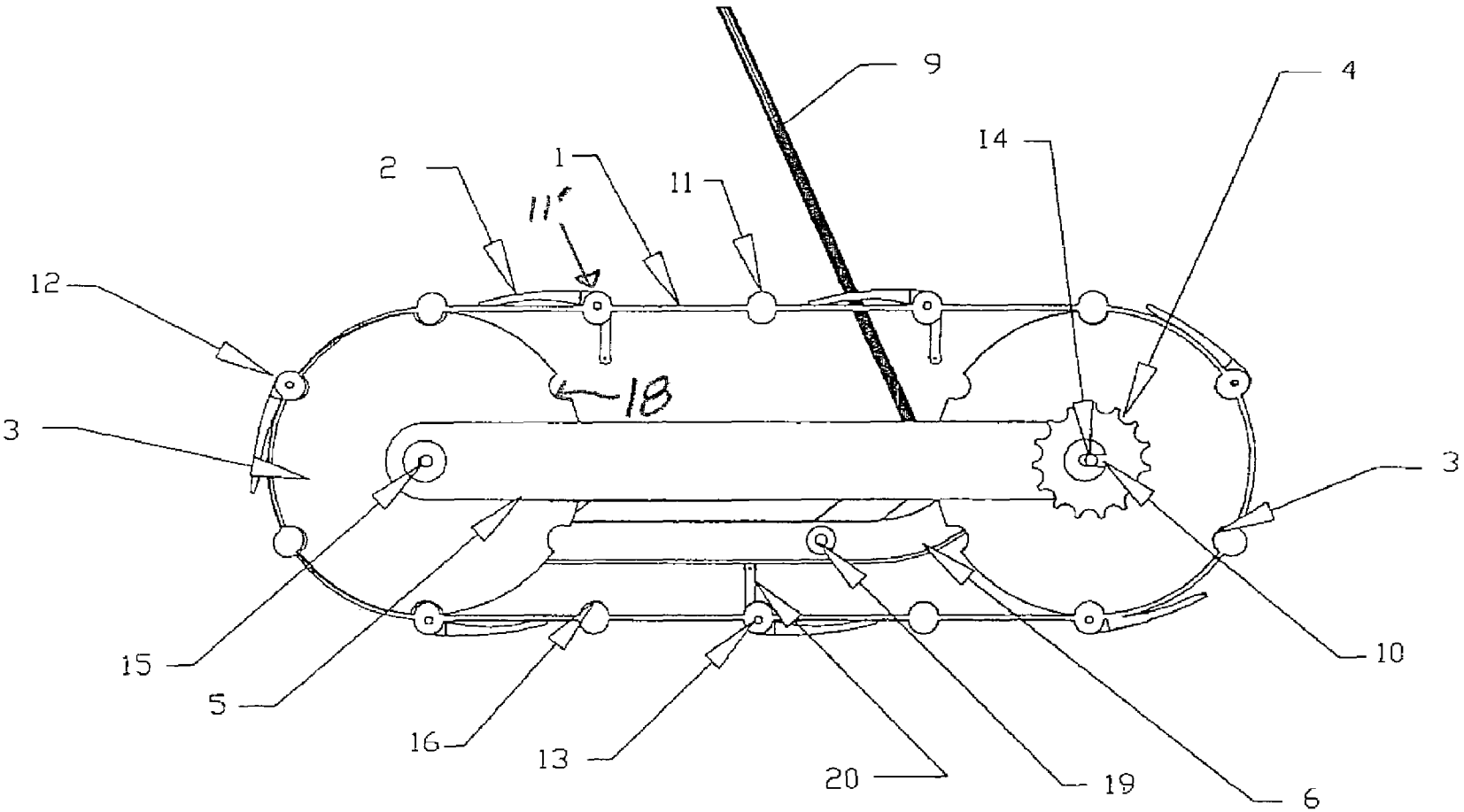
FIG. 2 is a right side elevational view of the preferred embodiment of the paddle track propulsion system showing the paddles disengaged, i.e. retracted, in accordance with the instant invention.
Figure 3:
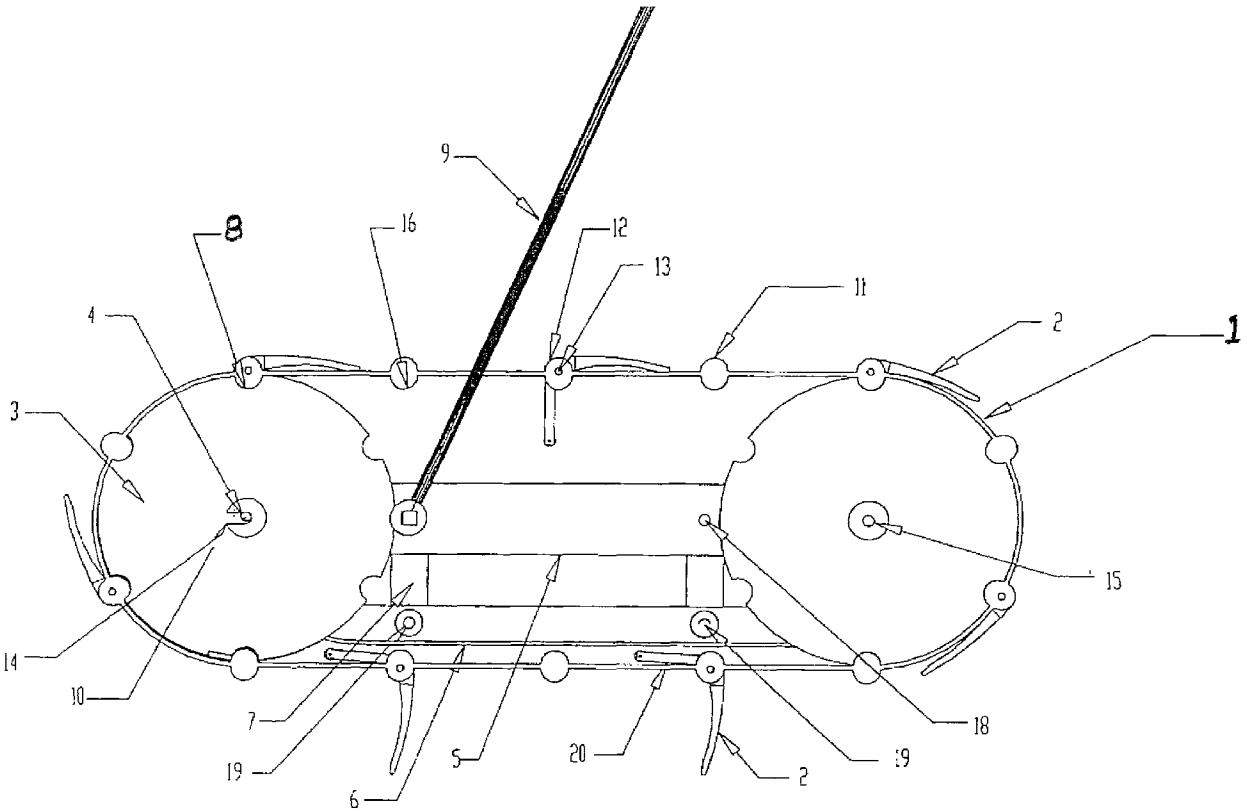
FIG. 3 is a left side elevational view of the preferred embodiment of the paddle track propulsion system showing the paddles engaged, i.e. extended, in accordance with the instant invention.
Figure 4:
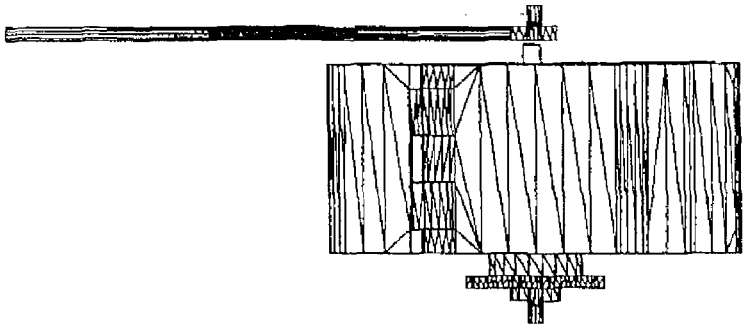
FIG. 4 shows front elevational views of the preferred embodiment of the paddle track propulsion system showing the paddles engaged and disengaged in accordance with the instant invention.
Figure 4:
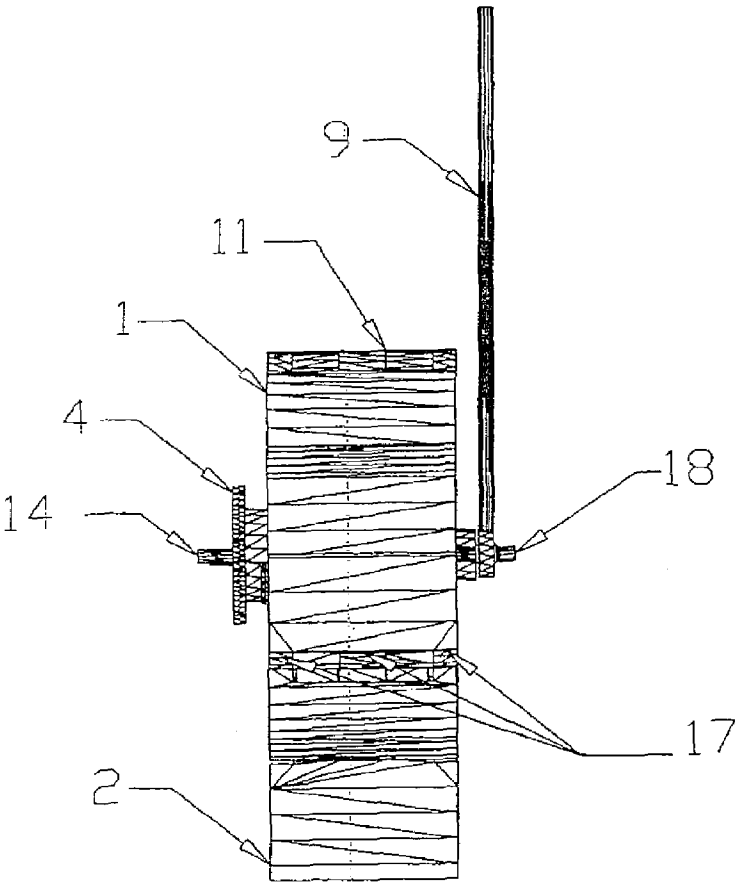
Figure 5:
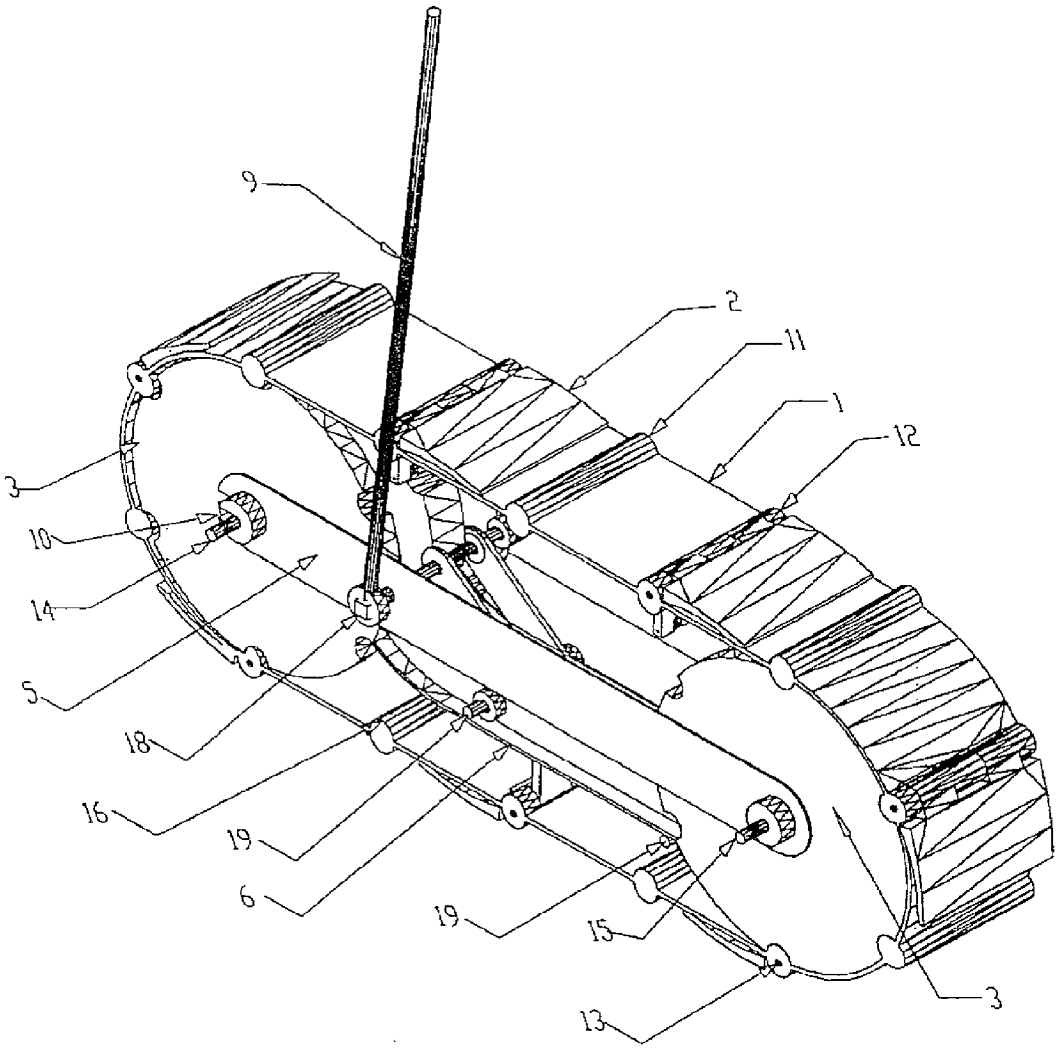
FIG. 5 is a left side isometric view of the preferred embodiment of the paddle track propulsion system with the paddles disengaged in accordance with the instant invention.
Figure 6:
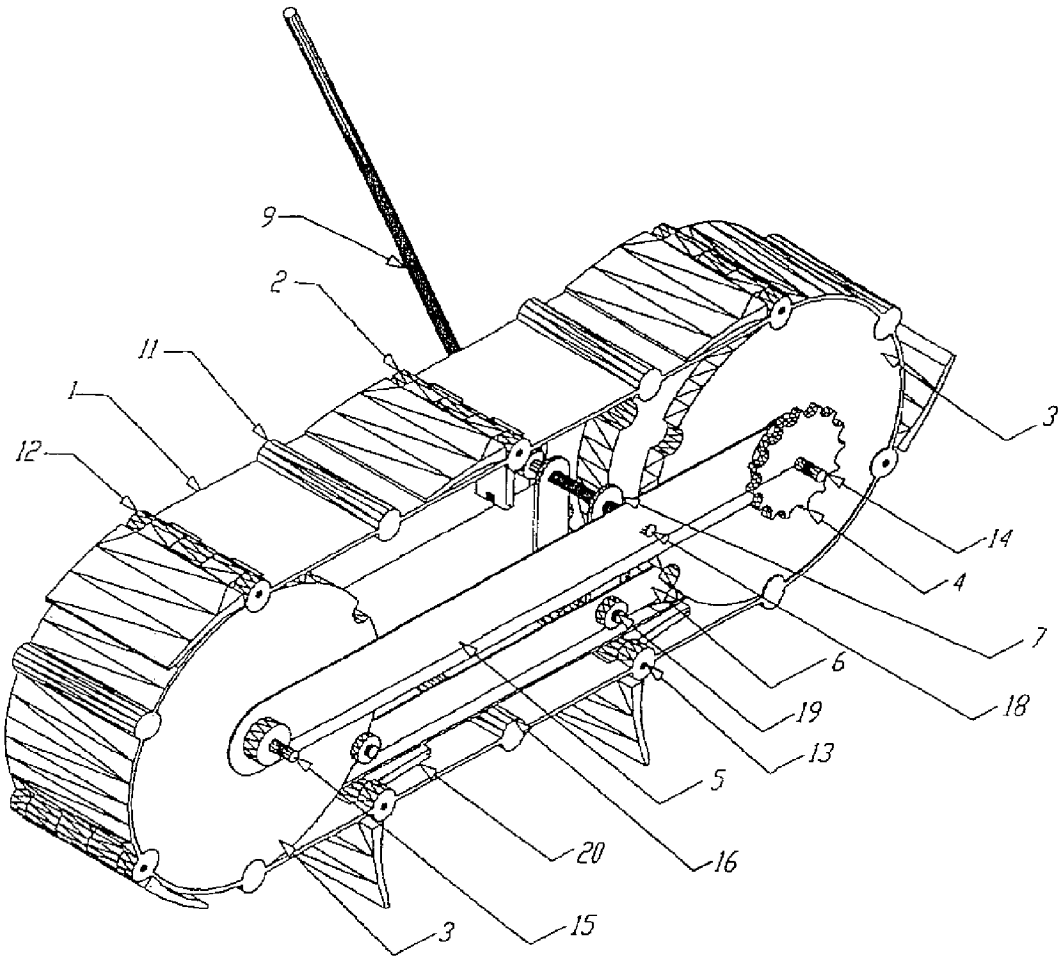
FIG. 6 is a right side isometric view of the preferred embodiment of the paddle track propulsion system with the paddles engaged in accordance with the instant invention.

With reference to FIGS. 2, 3 and 11, the engaging beams 6 comprise a pair of elongated "T" beams with the top of the tee making contact with the paddle engager rollers 24 to travel upon when the beams are articulated for extending the paddles 2. The leading edges of the engaging beams 6 have an upward curvature to trigger the paddle engager 20 vertically as it contacts the engaging beams 6. The engaging beams 6 function by using the selector lever 9 to lower the engaging beams 6 a given distance to allow only the thickness of the paddle engager 20 to travel the length of the engaging beams sandwiched between the track 1 and the engaging beams 6 and maintain the paddles 2 in an extended position for water locomotion until disengaging the beams 6 on their upward path. Referring to FIG. 11, the engaging beams 6 are connected to cam engaging brackets 7 on opposite sides, which are mounted to the frame with a shaft traversing their axes for are movement. The lower section of the cam 7 is attached to an engaging beam 6 and the upper section is fixed to the engaging selector lever 9, which creates an are movement for engaging and disengaging the beams 6 with the paddle engagers 20 thereby extending and retracting the paddles 2. The selector lever 9 is fixed to cam engaging brackets 7 by an engaging shaft 18 and reversing shaft 19 that mechanically communicates with the engaging beams 6 and corresponding cam brackets 7 to engage and disengage the beams 6 with the paddle engagers 20 when extending and retracting the paddles 2, respectively. The engaging shaft 18 is fixed to the lever 9 and engaging brackets 7 for lifting and lowering the engaging beams 6. The reversing shaft 19 traverses and engages the engaging beams 6 and cam brackets 7 facilitating rotational movement for engaging and disengaging the paddles 2.

Figure 13:
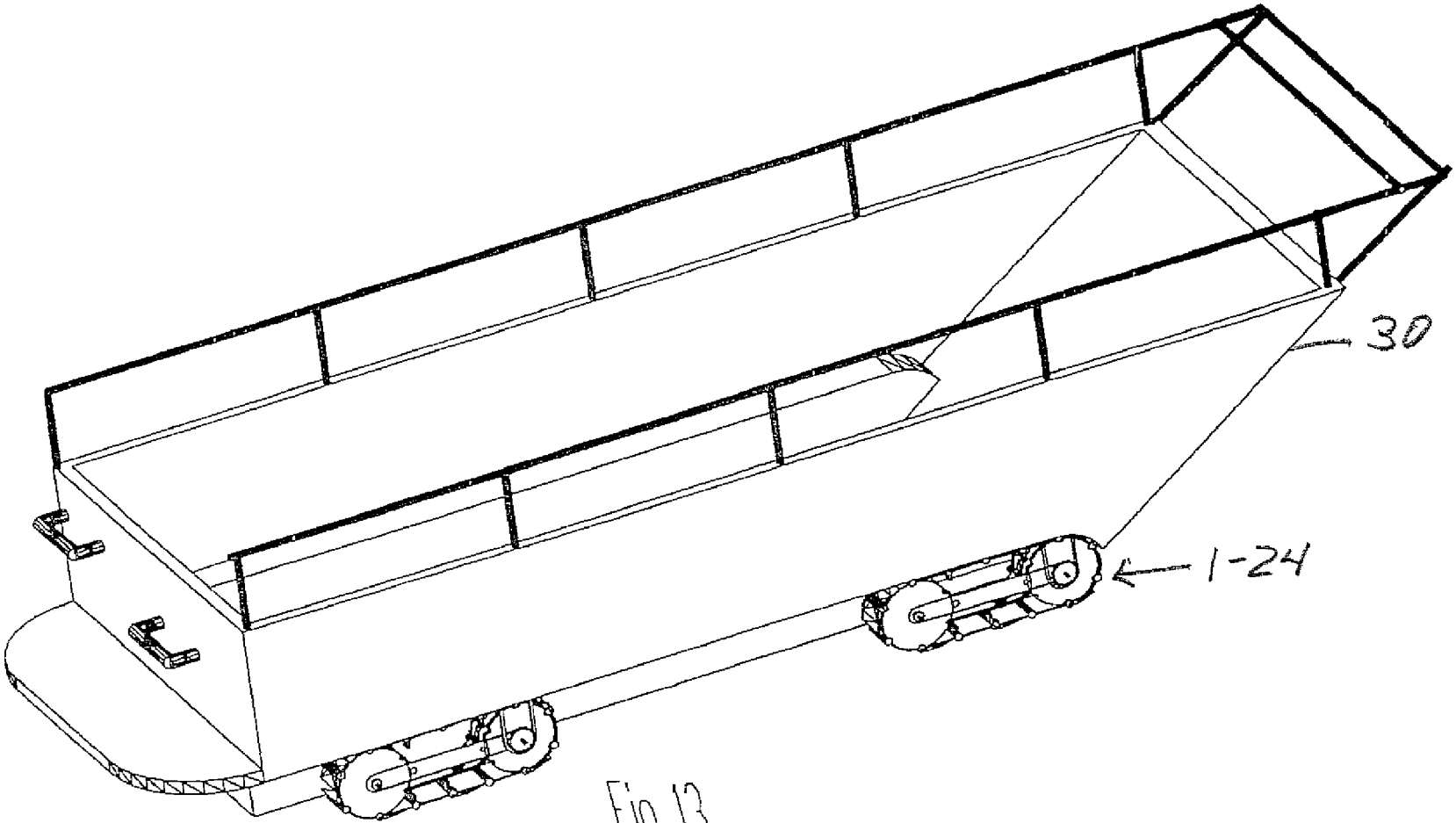
FIG. 13 is a perspective view of the preferred embodiment illustrating a plurality of paddle track propulsion systems mounted to a barge-like floater in accordance with the instant invention.

With reference to FIGS. 12 and 13, the paddle track propulsion system may be mounted to any vehicle, vessel or floater, such as a surf board, for allowing travel by land or water. With reference to FIG. 12, the paddle track propulsion system of the instant invention may be mounted to a floating vessel 25 with a seat 28 and a drive chain and sprocket 26 connected to a pedal system 27 that drives the lead sprocket gear 3 and moves the vessel 25. Alternatively, the pedal system 27 may be replaced with a motor that is energized and controlled for locomotion. With reference to FIG. 13, a plurality of paddle track propulsion systems may be employed with larger vessels or vehicles 30.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An amphibian paddle track propulsion system for enabling a floatation device, vehicle or vessel to travel on land and water, said system comprising:

a pair of sprockets;

a frame joining and separating said sprockets at a predetermined distance;

an endless paddle track mounted over and around said sprockets;

means for rotating one of said sprockets;

a plurality of terrain treads transversely joined to said track in predetermined spatial relation;

a spring loaded paddle assembly mounted to at least two of said terrain treads, said paddle assembly comprising a paddle having at least one paddle engager extension projecting from said paddle;

an engaging means for selectively holding said engager extension in a down position to extend the paddle outward and selectively releasing said engager extension to retract said paddle; and a lever connected to said engaging means by a bracket for lowering and raising said engaging means to extend and retract said paddle.

2. A system as recited in claim 1, further comprising:

a plurality of terrain treads being free of any said paddle assembly.

3. A system as recited in claim 1, wherein said terrain treads each comprise at least one opening for receiving and passing said engager extension.

4. A system as recited in claim 1, wherein said engaging means further comprises:

an elongated engaging beam connected to said bracket and said lever for causing said beam to engage and disengage said paddle engagers to extend and retract said paddles.

5. A system as recited in claim 1, wherein said pair of sprockets comprises:

a lead sprocket and a first axle for rotatably securing said lead sprocket to said frame; and a rear sprocket and a second axle for rotatably securing said rear sprocket to said frame.

6. A system as recited in claim 5, wherein said frame comprises a slot at an end proximal said lead sprocket for adjusting the tension of said paddle track.

7. A system as recited in claim 1, wherein said means for rotating comprises a chain sprocket disposed on an outer surface of one of said sprockets for rotating said chain sprocket to impart movement of said sprocket.

8. A system as recited in claim 5, wherein said means for rotating comprises:

a chain sprocket disposed on said lead sprocket for rotating said chain sprocket to impart movement of said lead sprocket.

9. A system as recited in claim 8, wherein said means for rotating said chain sprocket comprises:

a chain in mechanical communication with said chain sprocket; and chain sprocket power means, in mechanical communication with said chain, for moving said chain to impart rotational movement of said chain sprocket.

10. A system as recited in claim 9, wherein said chain sprocket power means comprises:

a pedal assembly, in mechanical communication with said chain, for rotating said chain by means of a person.

11. A system as recited in claim 9, wherein said chain sprocket power means comprises:

an electric motor, in mechanical communication with said chain, for rotating said chain.

12. A system as recited in claim 7, wherein said means for rotating said chain sprocket comprises:

a chain in mechanical communication with said chain sprocket; and chain sprocket power means, in mechanical communication with said chain, for moving said chain to impart rotational movement of said chain sprocket.

13. A system as recited in claim 12, wherein said chain sprocket power means comprises:

a pedal assembly, in mechanical communication with said chain, for rotating said chain by means of a person.

14. A system as recited in claim 12, wherein said chain sprocket power means comprises:

an electric motor, in mechanical communication with said chain, for rotating said chain.

* * * * *